United States Patent [19]

Key

[11] Patent Number: 4,510,728

[45] Date of Patent: Apr. 16, 1985

[54] WALL-PATCH ADAPTER

[76] Inventor: Clyde Key, 11426 Coriender Ave., Fountain Valley, Calif. 92708

[21] Appl. No.: 511,871

[22] Filed: Jul. 8, 1983

[51] Int. Cl.[3] ..... E04G 23/02

[52] U.S. Cl. ..... 52/514; 52/127.1; 52/743

[58] Field of Search ..... 52/514, 743, 127.1; 156/91, 98, 94

[56] References Cited

U.S. PATENT DOCUMENTS

| | | | |
|---|---|---|---|
| 2,598,194 | 5/1952 | Shippey | 52/514 |
| 3,690,084 | 9/1972 | Leblanc | 52/514 |
| 3,717,970 | 2/1973 | Rosenblum | 52/514 |
| 3,936,988 | 2/1976 | Miceli | 52/514 |
| 4,406,107 | 9/1983 | Schoonbeck | 52/514 |
| 4,471,594 | 9/1984 | Doyle | 52/514 |

*Primary Examiner*—J. Karl Bell

*Attorney, Agent, or Firm*—Francis X. LoJacono

[57] ABSTRACT

This invention is directed to a wall-patch-plug device to aid in the patching of holes in damaged plaster or gypsum-type-wallboard structures. One arrangement thereof is formed having a pair of circular plates joined together in a superimposed manner by means of a rotatable, eccentric, keeper member that allows the plates to be moved out of alignment with each other so as to be adjustably fitted within a hole in the damaged wall, thereby allowing patch material to fill the hole by using the patch plug as a backing or support for the patch material. A second patch plug is formed having a pair of slidable semicircular plates which are adjustable to engage within the hole of a damaged wall.

1 Claim, 8 Drawing Figures

WALL-PATCH ADAPTER

BACKGROUND OF THE INVENTION

Field of the Invention

This invention relates generally to a means for patching holes in walls and the like, and more particularly to a device to aid in the patching of holes in plaster walls and/or plaster-composition-type wallboards.

Various problems and difficulties are being encountered in providing suitable means for patching small holes having diameters from between one to six inches in plaster walls, particularly holes formed in plaster-related walls which are generally referred to as gypsum wallboard, or just wallboard.

For example, when a gypsum-type wallboard is damaged because a door is opened so wide as to cause the door knob to puncture a hole in the adjacent wall, it is desirable that the damaged area be repaired so as not to be generally noticeable, Wallboard of this type is formed in two sizes of panels. The smaller size panel measures four feet by eight feet and the larger panel measures four feet by twelve feet. These panels are nailed to the vertical studs, the studs being commonly spaced sixteen inches on center; and thus hollow areas are formed between the studs. If a hole is made in the hollow portion of the wall structure, it is difficult to fill with patch plaster or filler material specifically designed for such type of repair, since there is no backing or reinforcement to prevent the patching material from falling through into the hollow area.

Various types of impromptu methods or devices and arrangements are presently used in preparing holes in walls prior to the repairing of plaster, particularly with respect to gypsum wallboard. Often, paper is stuffed into the opening to be filled; or a screen material, if available, is mounted behind the opening so as to provide a base support or reinforcement for the plaster or filler material used for repairing the holes in the wall.

SUMMARY AND OBJECTS OF THE INVENTION

The present invention has been designed to provide a novel solution to the above-mentioned, long-established problems relating to the repairing of holes or openings in wallboard after it has been installed.

It is an important object of the invention to provide an adjustable wall-patch plug having a pair of circular plates joined in a superimposed manner by means of a rotatable, eccentric keeper that allows the two plates to be laterally moved relative to each other, so as to be adjustably fitted within a given opening to close the opening, thereby allowing one to fill the damaged area with a plaster-patch material using the patch plug as a backing for support.

Still another object of the invention is to provide an adjustable wall-patch plug wherein the two circular plates are adjustable from a concentric aligned position to an eccentric misaligned position, whereby each plate is moved laterally with respect to the other, allowing the plug to be locked within the opening in the damaged wall, and thus substantially closing the opening or hole.

It is still another object of the invention to provide a wall-patch plug of this type that allows the plates to be adjusted by inserting a key or like device into the eccentric keeper, whereby the keeper can be adjustably rotated.

It is another object of the invention to provide a device of this character that includes an eccentric keeper that is formed having a concentric boss member adapted to be received in a concentric hole of a first plate member, and an eccentrically positioned pivot pin adapted to be positioned in a corresponding eccentric hole in the second plate member, whereby the two plates are adjustably positioned out of alignment with each other, so as to become engaged within the opening in the damaged wall structure.

A further object of the present invention is to provide a device of this character that is formed having a pair of semicircular plate members wherein each respective plate is laterally extendable by means of a central keeper having extended cam arms to engage the respective plate members as the keeper is rotated.

It is a further object of the present invention to provide an adjustable wall-patch-plug device which is readily adjustable to holes of various sizes.

A still further object of the present invention is to provide a device of this character that has relatively few operating parts, and is simple to use.

Still another object of the invention is to provide a device of this character that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
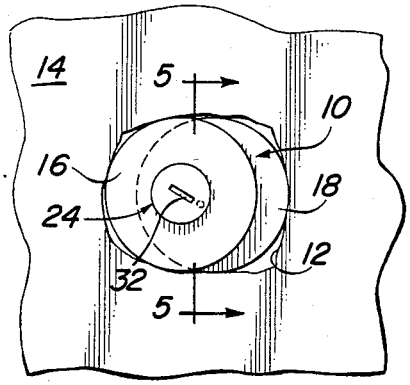
FIG. 1 is a front-elevational view of the present invention mounted in the hole disposed in a wallboard structure prior to receiving a plaster-patch material therein.
Figure 2:
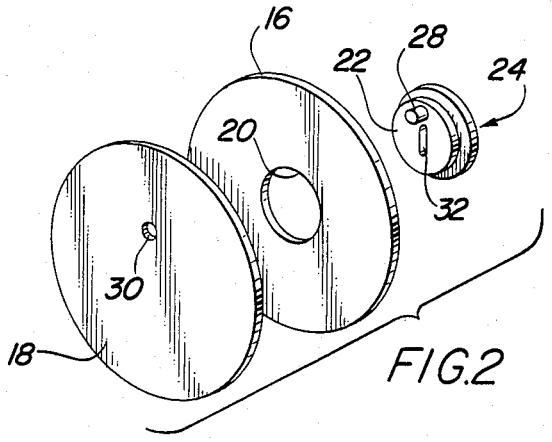
FIG. 2 is an exploded perspective view of the wall-patch-plug device, showing the preferred form thereof.

Referring to FIGS. 1 through 5 and more particularly to FIG. 1, there is illustrated the preferred embodiment of the present invention which is a wall-patch plug, generally indicated at 10. The wall-patch plug 10 is shown mounted and secured within a hole 12 caused by damage to the erected wall structure 14. The wall structure 14 represents a plaster-type wall or the commonly used gypsum wallboard, as previously described herein.

Wall-patch plug 10 comprises a pair of juxtaposed, circular, plate members 16 and 18. Plate member 16 will hereinafter be referred to as the first plate member 16 and plate member 18 as the second plate member. First plate member 16 is arranged so as to be the most often used front or forward plate when mounted in a hole, such as indicated in FIG. 1. This is because the first plate is formed having a central enlarged bore 20 which is adapted to receive the annular boss 22 of the rotatably keeper means, generally indicated at 24. Keeper means 24 is formed by an outer, front, enlarged, annular, head member 26 and the smaller or reduced-diameter boss 22. Projecting outwardly from the boss, there is provided an eccentric pin member 28 which is adapted to be secured to the second plate member 18. Head member 26, boss 22, and pin member 28 are preferably formed as an integral unit, as seen in the cross-sectional view of FIG. 4.

Accordingly, first plate member 16 is mounted over boss 22, boss 22 is received in bore 20, and plate 16 abuts against head member 26. Pin 28 is snapped through hole 30 disposed in second plate 18 and located off-center from the central axis a—a. Keeper 24 is also provided with a central keyway 32 which is adapted to receive a suitable matching key (not shown). Keyway 32 is shown as an elongated slot; however, any slot configuration that would accept a matching key would also be suitable.

Figure 4:
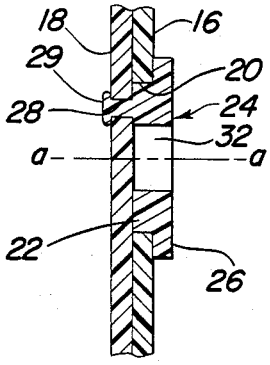
FIG. 4 is an enlarged cross-sectional view taken substantially along line 4—4 of FIG. 3, showing the eccentric positioning of the enlarged concentric boss member and the eccentric pivot pin.
Figure 5:
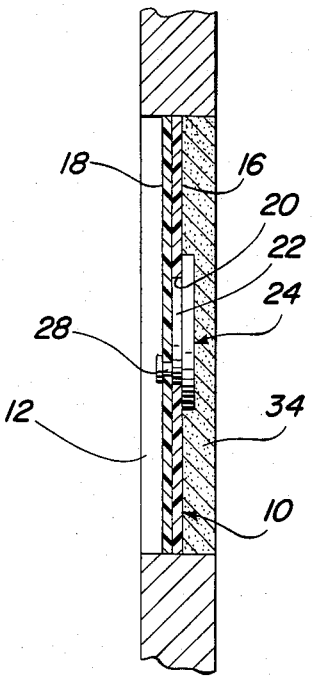
FIG. 5 is an enlarged cross-sectional view taken substantially along line 5—5, showing the keeper member rotated so as to laterally move the respective partitions in locking engagement within the opening, and further showing a layer of plaster-patch material covering the plug and the damaged front surface of the wallboard.

Projecting pin 28 can be provided with an enlarged head 29 that is forceably snapped through hole 30, thereby securing the two plates 16 and 18 to keeper 24, as seen in FIGS. 4 and 5.

Figure 3:
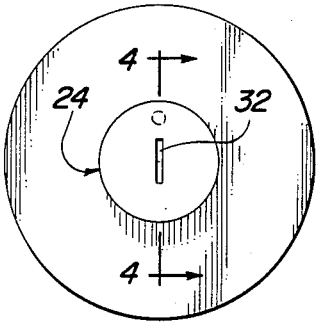
FIG. 3 is a front-elevational view of the wall-patch plug, wherein the two contiguous partitions are concentrically aligned with each other.

FIG. 3 illustrates wall-patch plug 10 as having both plates in an aligned mode prior to being inserted in a hole or opening, such as at 12. FIG. 1 shows keeper 24 rotated to one side which causes the keeper to rotate within bore 20, which in turn causes pin 28 to rotate around the central axis a—a. In doing so, second plate member 18 is moved laterally outward from first plate member 16. When plug 10 is inserted in opening 12 and keeper 24 is rotated, the two opposing plate members engage the inner wall of hole 12, as illustrated in FIGS. 1 and 5. Thus, when locked into the openings, the plug acts as a backing or reinforcement, so as to support the plaster-patch material 34 and prevent the material from falling out of the opening or hole.

Alternative Embodiment

Figure 6:
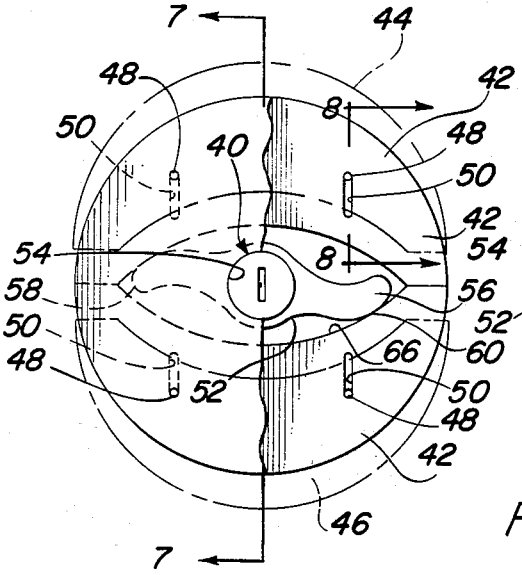
FIG. 6 is a front-elevational view of an alternative arrangement of the present device, with the outer cover plate thereof being broken away to show the position of the movable partitions which are interposed between the front and rear cover plates.
Figure 7:
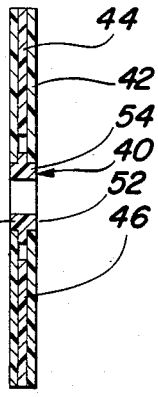
FIG. 7 is a cross-sectional view taken substantially along line 7—7 of FIG. 6, wherein the partitions are in a retracted mode.
Figure 8:
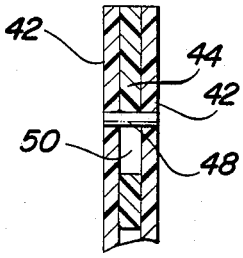
FIG. 8 is an enlarged cross-sectional view taken substantially along line 8—8 of FIG. 6.

FIGS. 6 through 8 disclose an alternative arrangement of the invention which comprises a keeper means 40 on which is mounted a pair of oppositely disposed outer guide walls 42 defining a housing. Interposed between outer guide walls 42 is a pair of oppositely positioned semicircular plate members 44 and 46 adapted to slide outwardly from the center of the outer wall members. Each plate member is movably mounted with respect to the outer walls by means of transverse pins 48 and corresponding slots 50 formed in the plate members. Each slidable plate 44 and 46 includes a pair of slots 50 positioned in parallel alignment to allow outward movement thereof, as seen in phantom lines in FIG. 6. Pins 48 are secured in the opposite walls 42, and pass through slots 50 as illustrated in FIG. 8.

In order to provide a means by which plates 44 and 46 are moved outwardly so as to engage the wallboard within an opening, keeper means 40 is formed having a central body with oppositely disposed boss members 52 adapted to rotate within central bores 54 disposed in each side wall 42, as shown in FIG. 7. Keeper 40 further includes extending arm members 56 and 58 having respective cam surfaces 60 and 62. The cam surfaces of arms 56 and 58 are positioned to engage the respective, inner, arcuate edges 64 and 66 of plates 44 and 46.

Accordingly, as keeper 40 is rotated within walls 42, the plates are forced outwardly so as to be readily secured within a hole or opening, such as at 12. The central body of keeper 40 is also formed having a keyhole therein to provide a means for rotating the cam arms 56 and 58.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A wall-patch-plug device adapted to aid in the patching of a hole in a damaged gypsum-type wallboard, the device comprising:

a pair of juxtaposed plate members adapted to be laterally adjustable relative to each other, so as to be secured within said hole in said wallboard to allow patch material to be supported therein;

wherein said pair of plate members includes:

a first plate member having a central bore disposed therein; and a second plate member having an eccentrically disposed hole therein;

said plates being superposed on each other and adapted to be laterally moved relative to each other; and means engaging said plates for adjusting and securing said plates within said hole of said wallboard;

wherein said adjusting-and-securing means comprises:

a keeper means which is formed having an enlarged, annular, head member;

a reduced-diameter boss adapted to be rotatably received in said central bore of said first plate member;

a projecting, eccentrically positioned, pin member adapted to be received in said eccentrically positioned hole of said second plate member; and a central keyway formed in said keeper means, whereby said keeper means is rotated, thereby causing said first and second plate members to move laterally with respect to each other, so as to lockingly engage said patch plug within said hole in said wallboard.

* * * * *